United States Patent [19]

Sjogren

[11] 4,075,964

[45] Feb. 28, 1978

[54] ICE MELTING SYSTEM

[75] Inventor: Charles Norman Sjogren, San Gabriel, Calif.

[73] Assignee: Global Marine, Inc., Los Angeles, Calif.

[21] Appl. No.: 609,030

[22] Filed: Aug. 29, 1975

[51] Int. Cl.[2] ..... B63B 35/08

[52] U.S. Cl. ..... 114/40; 165/41; 61/103; 175/7; 126/343.5 R

[58] Field of Search ..... 114/.5 D, 40; 165/1, 165/41; 61/103; 166/DIG. 1; 175/7, 5; 126/343.5 A, 343.5 R

[56] References Cited

U.S. PATENT DOCUMENTS

| | | | |
|---|---|---|---|
| 3,742,715 | 7/1973 | Nolte | 114/.5 D |
| 3,749,162 | 7/1973 | Anders | 114/40 |
| 3,759,046 | 9/1973 | Anders | 114/.5 D |
| 3,766,874 | 10/1973 | Helm | 114/.5 D |
| 3,831,385 | 8/1974 | Hudson | 114/40 |
| 3,837,311 | 9/1974 | Lea | 114/40 |
| 3,872,814 | 3/1975 | Rodriguez | 114/.5 D |

*Primary Examiner*—Albert W. Davis, Jr.

*Attorney, Agent, or Firm*—Christie, Parker & Hale

[57] ABSTRACT

A heat transfer system for melting thick layers of ice advancing toward an object facing the ice are disclosed. Elongated grooves or corrugations are disposed in the exterior surface of the object facing the ice. A heating fluid is circulated in intimate contact with the inside of the grooved surface, and a force is maintained between the grooved surface and the advancing ice layer. The grooves increase the heat transfer rate to the ice both by increasing the surface area exposed to the ice and by providing channels for controlling the flow of the melted ice liquid to initiate and maintain a forced convection mode of heat transfer that is necessary for high ice-melting rates. A preferred application of the invention is in oil and gas exploration and production in Arctic regions where moving ice sheets must be melted to maintain a drilling platform or oil production platform positioned over a submerged well site during periods when moving ice fields overlie the well site. At least a portion of the grooves have a vertical component to provide a flow path for the melted ice to the sea. The grooves are continued above the top surface of the ice being melted.

29 Claims, 9 Drawing Figures

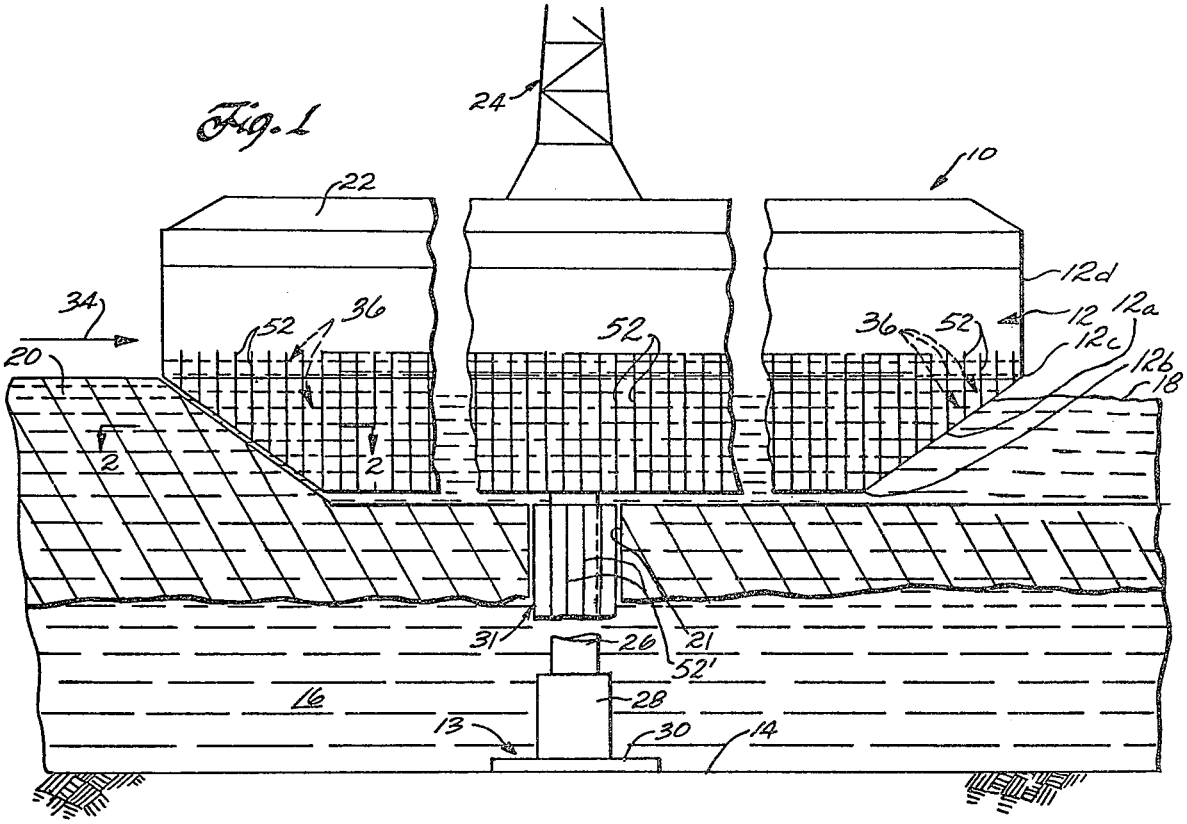
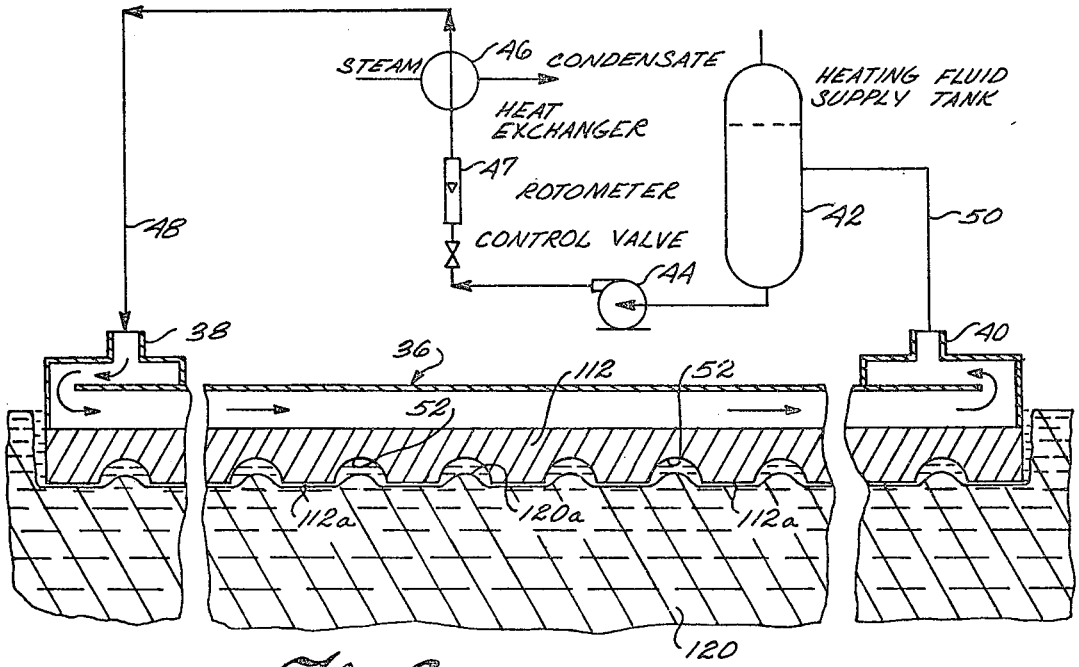
Fig. 3

ICE MELTING SYSTEM

FIELD OF THE INVENTION

This invention relates to a structure for improving the melting rate of ice moving toward a heated solid object the position of which is to be kept fixed. More particularly, one aspect of the invention relates to improving the heat transfer rate between a solid metal surface, such as, but not limited to, the hull of a floating vessel and an ice sheet moving toward the metal surface. Another use of the invention is in melting ice layers advancing toward oil drilling or production platforms supported on the sea floor.

BACKGROUND OF THE INVENTION

Substantial known reserves of oil and gas exist in Arctic regions, and many of these reserves lie below the surface of the Arctic oceans or other bodies of water in the Arctic regions. In the past, techniques have been successfully used for tapping offshore oil and gas reserves in sub-Arctic regions by using either offshore platforms erected on the ocean floor, semi-submersible moored drilling platforms, or moored drilling vessels. However, year-round use of these techniques in Arctic regions can be hazardous because of the ice problem which exists there during much of the year. For example, a permanent polar ice pack exists over much of the Arctic Ocean and varies in extent depending upon the time of year. During the Arctic winter, the size of the ice pack expands to positions very close to, and in some instances in direct contact with the shoreline. In those areas where the permanent ice pack does not come into direct contact with the shoreline, ice sheets which are fast to or fixed to the shoreline (known as land-fast ice) cover these areas and may extend 25 miles or more offshore.

The permanent ice pack slowly rotates and circulates in the Arctic Ocean, and land-fast ice also moves during the period in which it exists in the Arctic. The motion of a land-fast ice sheet is, overall, in random directions and in random amounts in response to tides, currents, winds and temperature changes. Ice sheets in the Arctic area may move as much as 60 feet per day and can exert substantial forces on a structure, such as a drilling or production platform, extending through the ice sheet from a supporting connection to the ocean floor. Thus, year-round use of conventional offshore drilling equipment in Arctic regions generally has been prevented. Moreover, it is uneconomical to use conventional offshore drilling equipment in Arctic locations only during the short ice-free season because of the time and cost involved in moving the equipment into and out of the Arctic location.

U.S. Pat. No. 3,749,162 discloses ice melting techniques intended to make it possible to explore, drill and produce oil and gas from submerged areas in Arctic regions. Generally, this patent discloses a buoyant vessel of conventional flat hull form maintained in a pool of water in a moving ice sheet over a submerged well site. Heat is applied to the ice from the flat hull for the purpose of melting the portion of the ice sheet which moves toward the hull. Well drilling operations are performed from the vessel while the vessel remains buoyant in the pool over the well site. The pool and the vessel remain fixed above the submerged well site. My laboratory tests disclosed below have shown that an ice melting system using such a flat hull design can produce reliable ice melting for only very low rates of ice movement, say about four feet per day or less.

U.S. Pat. No. 3,831,385 discloses an offshore structure having a heated conical base. The coned shape forces advancing ice sheets to lift and break in a flexural mode rather than crushing. The heated conical surface produces a thin film of melted ice water between blocks of ice and the metal surface, thereby reducing the frictional coefficient between sliding blocks and the cone. The combined net result is to reduce ice impingement forces on the structure when compared with an unheated conical surface or a vertical columnar surface. This patent does not contemplate complete melting of advancing ice to reduce impingement forces essentially to zero.

It is difficult to initiate and maintain high melting rates of moving ice simply by applying heat at relatively low temperature levels to the ice from a flat surface, as in U.S. Pat. No. 3,749,162, including the type of essentially smooth conical surface disclosed in U.S. Pat. No. 3,831,385.

SUMMARY OF THE INVENTION

The present invention provides a heat transfer system for establishing and maintaining melting rates of ice which are much greater than can generally be achieved with a flat heat transfer surface. Thus, the invention permits oil exploration drilling and production operations to be performed reliably and predictably substantially year-around in Arctic areas covered by moving ice fields. The invention also is applicable to melting of fresh water ice as well as salt water ice.

Briefly, my invention is based on the recognition that a heat transfer surface in the path of a moving ice sheet should be grooved or corrugated on the surface facing the advancing ice sheet to produce high melting rates of the oncoming ice. A sufficient amount of heat to raise the surface above the melting temperature of the ice is directed outwardly from the grooved surface to the adjacent ice sheet. A force is constantly maintained between the grooved surface and the ice. Each groove provides more surface than a flat surface of the same width. It has been found that such a grooved or corrugated surface assists in initiating a forced convection heat transfer mode at the surface/ice interface. As the ice melts, the liquid flows in the grooves, increasing the heat transfer rate which, in turn, increases the fluid flow rate. This continues until an equilibrium condition is reached in which the fluid flow rate maintains a forced convection heat transfer mode across the surface/ice interface, resulting in higher melting rates being obtained with much greater reliability than with a flat (ungrooved) heat transfer surface.

In a preferred form of the invention, the grooves are formed in the exterior surfaces of a floating vessel or of a fixed platform, for example, of the type used in oil drilling or production operations in Arctic waters. At least some of the grooves in the heat transfer surface extend in a direction having a vertical component, and such grooves extend above the top surface of the ice sheet. In this way, the grooves provide controlled flow channels for conducting the formed liquid across the surface/ice interface and thence to the sea, at flow rates which will insure good melting rates of the oncoming ice. When the invention is used on a floating vessel, or a fixed platform in an ice field, the grooves preferably extend over the entire exterior surface that is used to melt oncoming ice. The grooves are extended to a level well above the top surface of the ice sheet. Preferably, the grooves are oriented in a generally vertical configuration to provide a minimum distance from the top of the ice to the sea. However, the grooves can also extend in other directions, including horizontal, so long as a sufficient number of spaced grooves or corrugations are used for drainage channels to the sea.

Preferably, the grooved heat transfer surface is heated by circulating a heating fluid in direct contact with the inside surface opposite to the grooved exterior surface which faces the ice. The heating fluid is preferably circulated through a multiplicity of heating channels which are in individual sections. The flow rate is adjusted, depending on the size and shape of each channel, to provide for a minimum heat transfer coefficient in the range of about 300 to 400 Btu/sq.ft., hr., ° F so as to have a minimal film temperature drop. The system for supplying heating fluid to the individual heating sections includes means for controlling the areas of the grooved surface to which the heating fluid is circulated, so that all heating sections need not be used at one time with the same heat load. The only heating sections used are those needed to melt the oncoming ice and to prevent melted ice from re-freezing.

BRIEF DESCRIPTION OF THE DRAWINGS

These and other aspects of the invention will be more fully understood by referring to the following detailed description of the presently preferred embodiments of the invention, the description being presented with reference to the accompanying drawings in which:

FIG. 1 is a fragmentary cross-sectional elevation view showing a drilling platform according to this invention located in an ice sheet covering a submerged well site;

FIG. 3 is a fragmentary schematic view, partly in cross-section, showing a grooved portion of a surface facing a moving ice layer and schematically illustrating a laboratory-test heat transfer system for heating the grooved surface;

DETAILED DESCRIPTION OF THE ILLUSTRATED EMBODIMENTS

Figure 2:
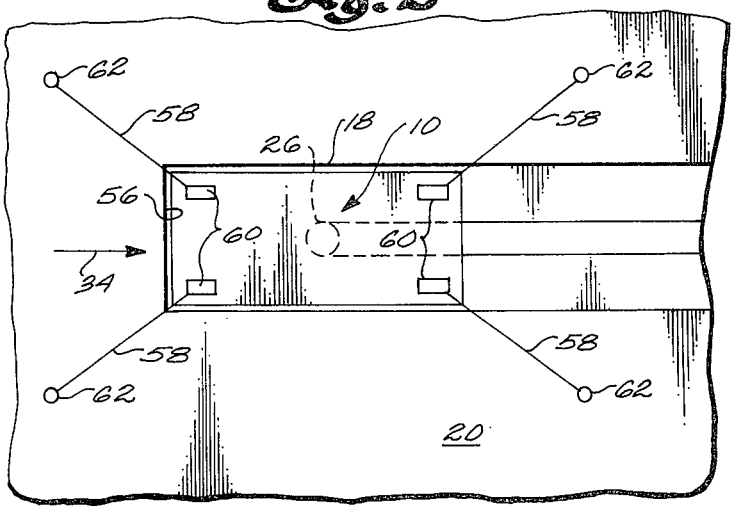
FIG. 2 is a top plan view showing a system for applying force between the drilling platform and the ice layer.

The present invention provides ice melting apparatus which is described in the context of, but not limited to, oil and gas exploration drilling and production operations at submerged well sites in Arctic regions. As illustrated in FIGS. 1 and 2, such operations are carried out by a drilling platform 10 having a metal hull 12. Preferably, the platform is a barge-like hull with a flat raked surface 12*a* extending angularly upwardly (at all locations around the hull rather than only at the bow and stern) from a hard bilge chine 12*b* at the keel plane to a second "waterline" hard chine 12*c* at the base of a vertical hull portion 12*d* below the gunwale and above the barge load waterline. Thus, the hull has the same general hull profile when viewed from the side (as in FIG. 1) or from either end.

The platform 10 carries equipment for performing desired operations such as the exploratory or production drilling for production of oil and gas from a submerged well site 13 located in a geological formation 14 under a body of water 16 in an Arctic area. Platform 10 floats in a pool 18 of water formed in an ice sheet 20 which extends over the submerged well site. The pool 18 communicates through the ice sheet by a hole 21 formed in the ice below the center of the platform for allowing water 16 to fill the pool to buoyantly support the platform in the pool; FIG. 1 shows an ice sheet many feet thick, and it will be understood that the ice sheet may be of lesser thickness so as not to extend below the keel plane of the hull.

The deck of platform 10 is enclosed within a protective insulated deck house 22 which covers all the equipment normally used in a conventional floating drilling vessel. Such equipment includes a derrick tower 24 which extends upwardly from the platform deck over a well (not shown) formed through the center of the platform. The derrick tower 24 is a component of a drilling facility of conventional configuration which includes an upright, elongated riser pipe 26 extending downwardly from the drilling platform through the hole 21 formed in the ice sheet 20 below the platform. The bottom of the riser pipe is connected to a blowout preventer 28, or other conventional equipment, mounted on a landing base 30 overlying the well site 13. An ice-melting collar 31 extends around the portion of the pipe 26 adjacent the moving ice sheet 20.

The ice sheet 20 moves laterally relative to the well site 13, either constantly or intermittently, and in any direction. For the purpose of this description, it is assumed that the ice sheet 20 is moving toward the platform 10 in the direction of the arrows 34 shown in FIGS. 1 and 2. As described in greater detail below, the platform 10 and the collar 31 include means for transferring thermal energy from the hull 12 and the outer surface of the collar to the ice sheet 20. The transferred heat maintains the pool 18 in an unfrozen condition and melts the walls of the oncoming ice sheet. Thus, as the ice sheet 20 moves laterally over the submerged well site 13, the platform 10 remains buoyantly supported in the pool 18 and in a substantially fixed position above the well site, with substantially no significant impingement forces being exerted on the platform 10 or the riser pipe 26 from the moving ice sheet.

The present invention provides means for establishing and continuously maintaining relatively high melting rates between the ice sheet 20 and the portions of the hull 12 (and the collar 31) toward which the ice sheet is moving at any given time. FIG. 3 schematically illustrates a laboratory test apparatus according to this invention for applying heat to an ice layer 120 from an object, such as a metal hull section 112, facing the ice layer 120.

In the laboratory tests, blocks of ice simulating the ice layer 120 were loaded onto an ice trolley which was disposed in a test tank and movable toward the submerged hull section 112. Heat was transferred to the inner surface of the hull section 112 by heating fluid circulated through multiple heating channel sections 36 attached to the inner surfaces of the hull section 112. The heating channels allowed the heating fluid to be circulated in direct contact with the inner surfaces of the hull section. The heating fluid was a mixture of water plus 5 to 7% by volume of commercial ethylene glycol. Force was applied continuously by the ice blocks to the hull section by parallel cables (not shown) fastened to the bottom of the ice trolley and run to a pair of air cylinders (not shown), one on each side of the ice trolley. Tests were conducted in a tank containing a thick layer of crushed ice in ice water surrounding the hull section and the ice trolley.

Each heating channel 36 included an inlet 38 and an outlet 40 for circulating the heating fluid through the channels. The system for circulating the fluid included four supply tanks 42 for the heating fluid, four pumps 44 connected between the supply tanks 42, four heat exchangers 46, and four rotameters 47 for measuring the flow rate of the heating fluid. The pumps delivered controlled amounts of heating fluid to the heat exchangers for heating the fluid by indirect exchange with steam, for example. The temperature of the heating fluid exiting the exchangers was controlled and was delivered to four lines 48 (only one is shown in FIG. 3) leading to corresponding inlets 38 of respective hull heating channel sections 36. Heating fluid circulated through the heating channel sections passes through the outlets 40 of the channels and through corresponding return lines 50 (only one is shown in FIG. 3) leading back to the supply tanks 42. The rotameters 47 measured the flow rates of heating fluid to each of the four heating sections. Each heating section had twelve channel sections 36. Thermocouples (not shown) measured the inlet temperatures of the heating fluid to each of the four heating sections, the outlet temperatures of the fluid from the sections, and the temperature of the water in the pool 118.

In the laboratory test structure, the hull section was a ½ inch thick aluminum plate placed on a rake angle of 35° to the horizontal. A plurality of upwardly extending and spaced apart, parallel elongated grooves 52 were formed in the outer surface of the hull section 112. The grooves were linear and were formed in a symmetrical pattern across the face of the hull section. In general, the grooves were vertically oriented in the sloping outer surface of the hull section. The grooves were semi-circular in cross-section, as shown in FIG. 3, and each groove had a diameter of about ⅜ inch. The grooves were spaced equally apart by a center-to-center distance of about ¾ inch. However, this arrangement of the grooves is not believed to be critical, because a corrugated hull, or a hull in which the grooves extend in directions other than vertical can be used, as will be described in greater detail below.

The heating channel sections 36 overlapped the grooves 52 from top to bottom. Moreover, the tops of the grooves and the top level of the heating channels extended above the top surface of the ice layer 120.

Laboratory tests were conducted initially to determine the ice melting rates obtainable with a flat hull section. In the tests the ½ inch aluminum hull section 112 was 16 feet in height and 44 inches wide. The face of the hull section was overlapped by a layer of ice made from fresh water ice blocks in precision forms producing blocks measuring 12 inches thick by 23-¼ inches high by 48 inches long. The ice blocks were placed in the forms, and the spaces between the blocks were filled with walnut-sized ice, and then ice water was added in successive steps, freezing after each addition. The blocks formed a monolithic chunk of ice weighing about 6000 pounds when positioned in the ice trolley. After the ice trolley was in place, ice water and crushed ice were added to the test tank. The ice was forced against the hull section 112 during the tests, and the force was varied by varying the air pressure to the air cylinders (not shown).

Ice melting rate was measured by two observers who read the displacement of the ice trolley on two scales at 60-second intervals and to the nearest 1/16-inch. Four heating sections, each having twelve of the heating channels 36 shown in FIG. 3, overlapped the inner surface of the aluminum hull section 112. The flow rate of heating fluid to the heating channel sections 36 was measured by the rotameters, and temperatures of fluid in and out of each heating section were recorded every 40 seconds. In addition, a multi-point temperature indicator was used to check various temperatures of the system. Temperatures of the heating fluid generally were varied within the range of about 85° to 130° F. The temperature level is not believed to be critical, but is dependent primarily on the thickness and the thermal conductivity of the metal in the hull section.

The results of the tests with the flat hull section (not grooved) generally showed that ice melting rates in the range of four feet per day of ice encroachment can be reliably maintained with a flat hull section. However, ice melting rates in excess of 4 feet per day could not be obtained reliably, although rates to 60 feet per day were achieved during the tests. In general, the tests using the flat hull section indicate that an unstable heat transfer condition results when a flat heated metal surface is used to melt an oncoming ice layer.

Tests with the grooved hull section 112 revealed that ice melting rates well in excess of 30 feet per day could be obtained with high reliability.

It is believed that the greatly improved melting rates obtained from a grooved surface are explained as follows. In the transfer of heat from a metal plate section to an adjacent ice layer, three types of heat transfer are involved in melting the ice, namely, conduction, natural convection and forced convection. Each mode of heat transfer depends upon the conditions existing at the metal/ice interface. Conductive heat transfer occurs when the ice layer comes into contact with the heated metal surface and there is a negligible gap between the metal and the ice. Natural convection comes into play as the gap between the metal and the ice widens somewhat to allow convective currents to form. As long as natural convection heat transfer is present at the metal-/ice interface, the heat transfer coefficient remains too low for appreciable ice melting rates to result. Forced convection heat transfer at the interface is required to produce high ice melting rates. To develop and maintain a forced convection condition, a good rate of heat transfer between the metal and the ice is required. This is obtained by establishing an appreciable flow rate of the melted ice, which can only be accomplished by an increased heat transfer rate. The situation can be thought of a a feedback system. When melting large amounts of ice over extended surfaces, it is of great importance that the melted ice liquid be removed from the interface at a rate sufficient to maintain the forced convection heat transfer condition and prevent the system from falling back into natural convection. If the system falls back into natural convection, there will be a significant drop in the melting rate.

The tests have shown that a forced convection mode of heat transfer between two flat surfaces (flat, ungrooved hull surface and therefore flat ice surface) is possible, and while this condition was achieved many times during my tests, it is more often an unstable heat transfer condition and is difficult to initiate. Flow of melted ice between the flat, ungrooved surface and the ice cannot be controlled or directed predictably, and therefore melting rates above say four feet per day cannot be obtained reliably.

When the metal surface is grooved or corrugated, the tests have shown that a forced convection heat transfer mode can be developed and maintained with relatively no difficulty. The grooves or corrugations provide increased heat transfer areas plus conduits for the controlled flow of melted ice to the sea. The heat transfer area of the groove is some 1.57 times greater than the projected groove area. Thus, initiation of forced convection heat transfer in the groove is enhanced and this mode generally is maintained by the channels 16b (see FIG. 3) formed between the grooves and the ice. The formed channels allow melted ice to flow in directed, confined and controlled paths to the sea at flow rates sufficiently high to maintain a forced convection heat transfer mode.

A suitable force must be applied constantly between the metal surface and the ice layer to control the width of the liquid gap between the metal and the ice to maintain a forced convection heat transfer mode. An equilibrium condition is established where the pressures in the liquid gap formed by the melting ice and its flow balance the applied forces. Should the applied force be reduced, allowing the melted ice gap to widen, the heat transfer rate will be reduced sufficiently to allow the system to fall into natural convection, with resulting ice melting rates being greatly reduced.

FIG. 3 illustrates the effect of a forced convection heat transfer condition between the grooved metal hull section 112 and the adjacent ice layer 120. Heat is concentrated in the grooves 52, resulting in a greater transfer of heat in those areas than in the front flats or lands **112*a* of the hull section. The increased heat initiates a forced convection mode of heat transfer, and the flow of relatively warm fluid in the grooves erodes the ice. As shown in FIG. 3, the portions of the ice layer shown at 120*a*** partially enters the groove cavities during the forced convection process.

Figure 6:
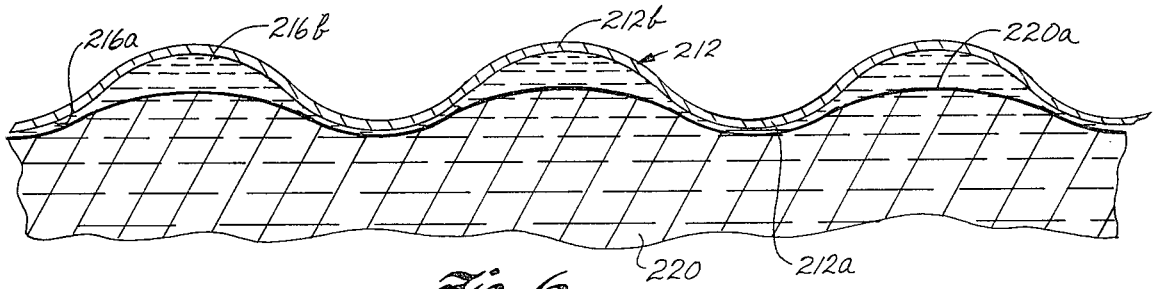
FIG. 6 is a fragmentary cross-sectional top plan view showing a corrugated surface facing a moving ice layer.

FIG. 6 illustrates an alternate heat transfer structure according to this invention which comprises a corrugated metal section 212 adjacent an ice layer 220. This figure illustrates how the projecting portions **212*a* of the corrugations which confront the ice layer produce a film 216*a* of melted ice liquid which flows laterally into channels 216*b* and thence to the sea during forced convection. The wider gaps 216*b* of melted ice are produced adjacent the projecting portions 220*a* of the ice in the remote portions 212*b*** of the corrugations due to the increased heat transfer area and concentrated heat input in the concavities plus the increased flow rate of melted ice.

Referring again to FIG. 1 and the drilling platform 10, the heat transfer collar 31 on the riser pipe 26 has a series of vertically extending grooves 52' extending around its outer surface. The heat transfer collar internally includes heating channel sections (not shown) similar to heating channel sections 36 for circulating a heat transfer fluid into direct contact with the interior surface of the collar adjacent the grooved areas to melt the portion of the ice layer which moves toward the riser pipe 26. It will be appreciated that structures virtually identical to collar 31 may be provided around the exterior of the pylons or other support members of drilling or production platforms to enable platforms to be used year-round in Arctic regions where moving ice has heretofore been a problem.

FIG. 2 illustrates a system for mooring the platform 10 to the ice sheet 20 and for applying force between the platform and the ice. The mooring system includes multiple mooring lines 58 extending outwardly from corresponding onboard winches 60 to respective anchors 62 located in the ice sheet. During use, the effective lengths of the various mooring lines can be continuously adjusted to apply force between the grooved portion of the hull and the section of the melted ice boundary which is moving toward the hull at any given time. As explained above, the tension in the lines is controlled so that, at any given time, a sufficient amount of force is applied between the vessel and the ice to maintain a forced convection heat transfer condition between the hull and the ice, and melt the ice as fast as it moves toward the vessel.

It will be appreciated that the force applied between the ice and the heat transfer surface can be provided by the action of the ice itself advancing toward a fixed heat transfer surface, such as a pylon or other support member, for example, which is rigidly fixed in the path of movement of the advancing ice layer.

The mooring system shown in FIG. 2 also can be used to provide the equivalent of a "thermal saw" for applying force to the boundary 56 of the moving ice sheet by the portions of the hull overlapped by the heating sections. By alternating the forces on opposing tension lines, the platform can be oscillated slowly back and forth with low frequency and relatively low amplitude. The platform is oscillated in a direction transverse to the direction of the grooves. This moves the lands **112*a***, or other more outwardly projecting portions of the hull, back and forth against the ice layer. If the ice layer is moving at a very fast rate, then the "thermal saw" can increase the melt rate when compared with a stationary vessel. The effect of the oscillating movement of the vessel is to make the flow area for melted ice larger than normal to move the melted ice away from the heat transfer area at a greater rate. This accommodates the faster moving ice by producing much higher flow rates of the melted ice at the hull/ice interface.

Figure 4:
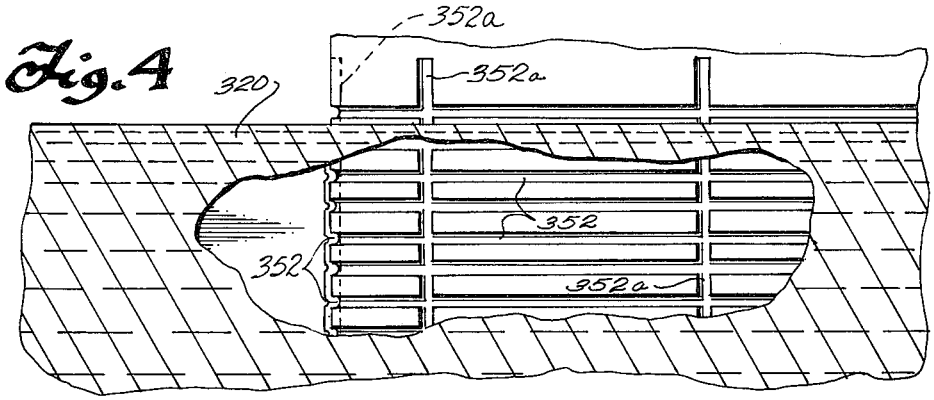
FIG. 4 is a fragmentary schematic elevation view, partly in cross-section, showing an alternate groove pattern according to this invention on a surface facing a moving ice layer.
Figure 5:
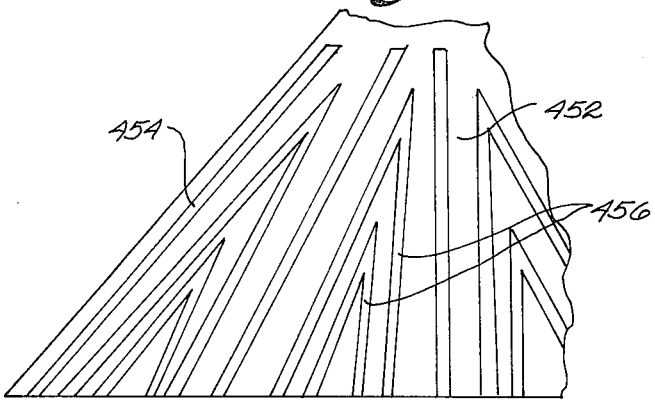
FIG. 5 is a fragmentary schematic elevation view, partly in cross-section, showing a further alternate groove pattern on a coned surface facing a moving ice layer.

FIGS. 4 and 5 show forms of grooved hull sections according to this invention other than those with vertical grooves, as shown in FIG. 3, or vertically extending corrugations, as illustrated in FIG. 6. In the hull section shown in FIG. 4, horizontally extending and parallel grooves or currugations 352 with intermittent vertically extending drainage channels **352*a* are used. The horizontal grooves 352 act in the same manner as described above for FIGS. 3 and 6. The vertical grooves 352*a* act primarily as drainage channels to allow the melted ice liquid to flow to the sea. The vertical grooves extend above the top surface of the ice layer 320**.

FIG. 5 shows an alternate grooved heat transfer surface configuration showing that the grooves which provide flow channels for melted ice need not be continuous from top to bottom of the heat transfer surface. FIG. 5 shows a conical-shaped surface 452, which in practice can be an ice melting shroud around the fixed pylon of a monopod-type offshore platform, for example. The conical surface has grooves 454 which extend radially from the apex of the cone. These grooves can extend continuously from top to bottom of the coned heat transfer surface 452. The spaces between the radial grooves may include grooves 456 shaped as inverted V's or chevrons. These grooves do not extend to the top of the surface 452. As a further alternative (not shown), a heat transfer surface shaped as a cone, or the like, could include spiral-shaped heat transfer grooves with generally upright drainage channels, at least some of which extend to a level above the top of the ice layer.

Other alternate groove patterns also can be used, as long as they result in sufficiently high melt rates by forced convection to melt an adjacent ice layer at a rate at least equal to its rate of movement toward the grooved surface. At least some of the grooves must extend above the top of the ice layer and they must also provide drainage for the melted ice liquid away from the grooved surface to the sea.

Figure 8:
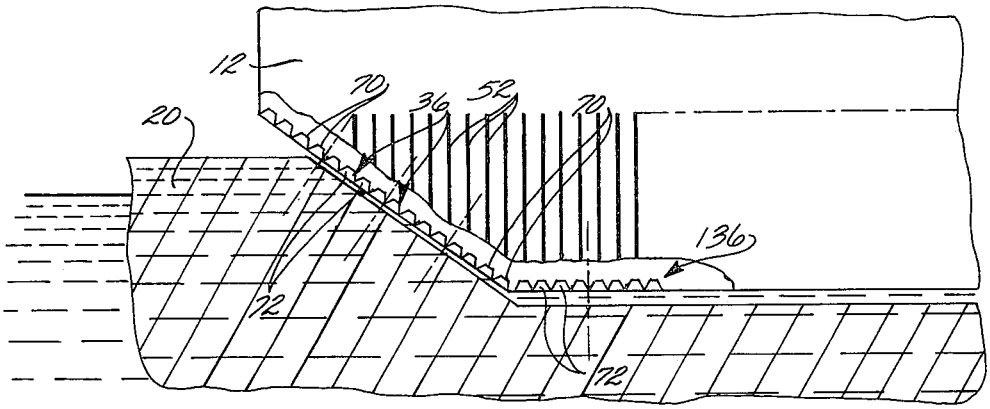
FIG. 8 is a fragmentary elevation view, partly in cross-section, taken on line 8—8 of FIG. 7.
Figure 9:
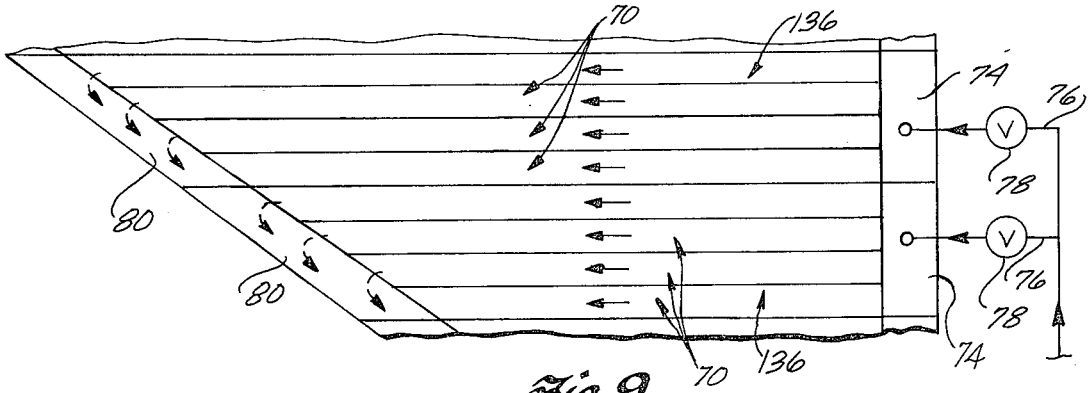
FIG. 9 is a fragmentary schematic elevation view showing the heating channel sections within the elongated circle 9 of FIG. 7.
Figure 7:
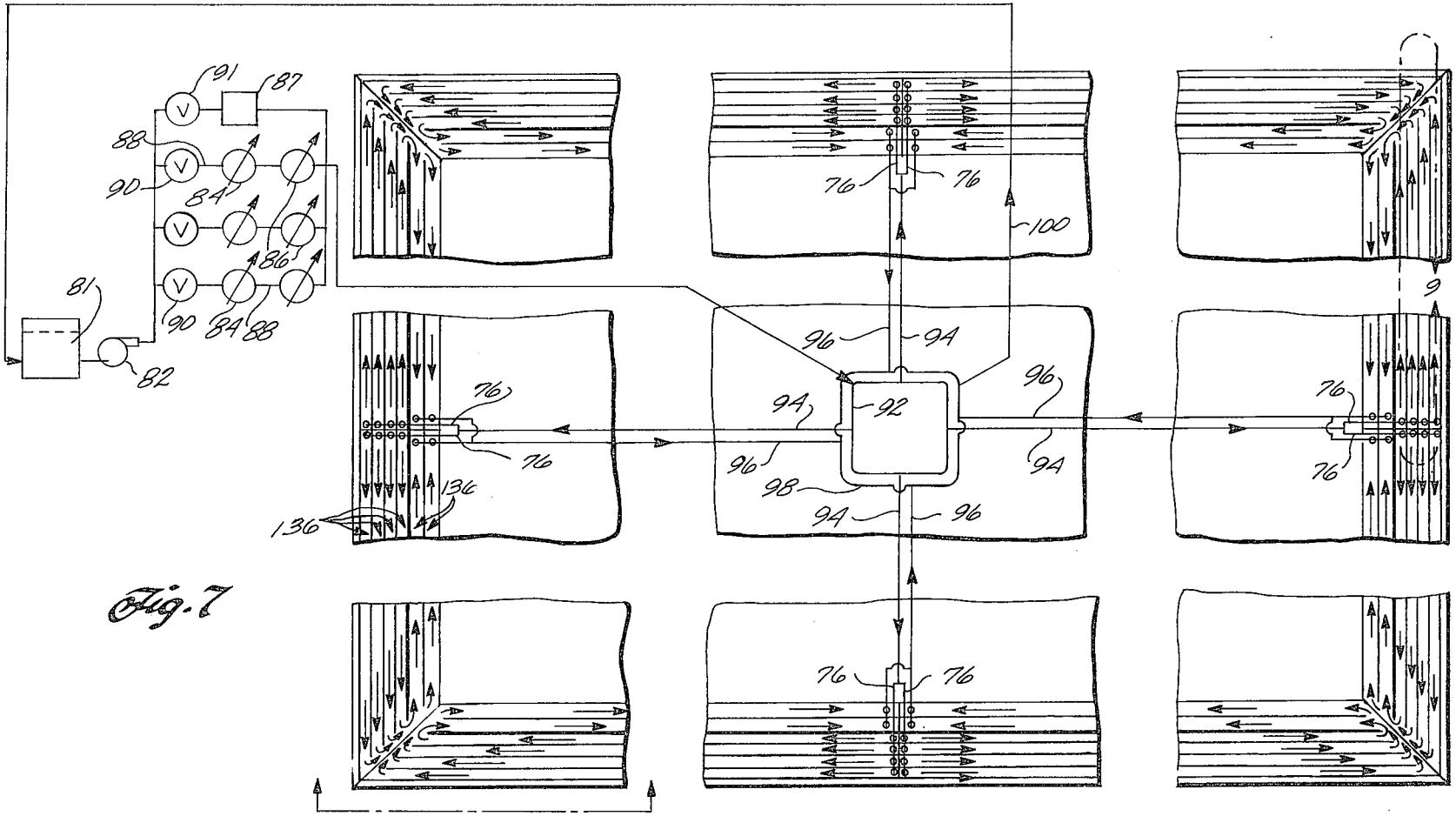
FIG. 7 is a fragmentary schematic top plan view illustrating a hull heating system for a drilling vessel similar to that shown in FIG. 1.

FIGS. 7 through 9 illustrate a preferred system for heating the grooved hull portion of a barge-like vessel, such as the vessel illustrated in FIG. 1. Heating fluid is circulated into direct contact with the hull through multiple heating channel sections 136 attached to the inner surface of the hull opposite the grooved portions of the hull. As shown in FIG. 7, the multiple heating channel sections 136 also circulate heating fluid into direct contact with the flat bottom of the hull immediately inboard of the bilges **12*a* around the entirety of the bottom. As shown best in FIG. 8, the heating channel sections 136 extend above the top surface of the ice layer 20**.

Each heating section 136 comprises a series of side-by-side, parallel, elongated generally U-shaped channels 70 forming conduits 72 extending along the inner surface of the hull.

Each heating section 136 also includes an inlet 74, opening to each of the conduits in the section, for receiving a supply of heating fluid through a respective inlet line 76. The flow of heating fluid from each inlet 76 is controlled by a separate valve 78 so that the heating fluid can be circulated through the conduits 72 of any desired heating section 136.

Heating fluid circulated through the conduits of each heating section 136 merges to a single outlet channel 80. When multiple heating sections 136 are attached to the hull surface one above another, the outlet channels 80 of adjacent heating sections cooperate to form a downwardly extending, continuous outlet conduit which enlarges proceeding downwardly to accommodate the increasingly greater mass flow of fluid at the bottom of the heating section.

As shown best in FIG. 7, eight separate groups of heating sections 136 are associated with the hull surfaces, there being two groups of sections at each of the forward, aft, and side hull surfaces. Each group extends from the mid-point of the hull surface to one of the quarters (i.e., corners) of the vessel. In each group some of the heating sections are associated with the hull surface above the bilge chine **12*b***, and others of each group are associated with the keel inboard of the bilge chine.

Those heating sections associated with the hull above the bilge chine **12*b*** have their inlet ends at the mid-length of the hull surface and their outlet ends merging into the previously-described outlet conduit at the quarter of the vessel. Those heating sections associated with the keel inboard of the bilge chine have their inlet ends at the same quarter and their outlet ends adjacent the mid-length of the hull surface below the inlet ends of the other heating sections in the same group.

Those heating sections associated with the hull above the bilge chine extend sufficiently above the load waterline of the hull that they are always above the top of an adjacent ice sheet.

A heating fluid flow path is provided through the several sections of each group so that the warmest heating fluid is circulated through those heating sections above the bilge chine where heat transfer requirements to the exterior of the hull are the greatest. The relatively cooler fluid flows to the outlets from the group of sections along the inner surfaces of the keel inboard of the bilge chine where the heat transfer requirements to the exterior of the vessel are reduced.

The presently preferred system for heating and circulating fluid through the heating sections 136 is illustrated in FIG. 7. The vessel includes an onboard storage and makeup tank 81 for containing a supply of heating fluid such as a mixture of water and glycol. A pump 82 delivers the heating fluid to onboard heat exchangers which include a number of jacket water exchangers 84, through which the jacket water for cooling the diesel engines is circulated, and a number of exhaust gas exchangers 86, using the exhaust gases of the onboard diesel engines as a source of heat. The engines are used for drilling operations. An additional or auxiliary heater 87 also is available to supply heat when the engines are not in use or when their waste heat is insufficient to provide the required amount of heat. The heating fluid is delivered to the heat exchangers through multiple lines 88 each being controlled by a respective automatic control valve 90 and each extending to a respective one of the jacket water exchangers 84 and exhaust gas exchangers 86. A control valve 91 controls the flow of heating fluid to the auxiliary heater 87.

Heating fluid from the heat exchangers is then fed to a supply ring conduit 92 which distributes the heating fluid to separate supply conduits 94 extending to the inlet lines 76 leading to the heating section inlets 74 via valve 78. The heating fluid then flows through the conduits 72 of each heating section 136, returning to the mid-line of each side and end wall of the hull via the heating sections on the bottom of the hull. Return conduits 96 allow the fluid to flow to a return ring conduit 98 which, in turn, distributes the return flow of heating fluid to a return line 100 leading back to the supply tank 81.

The supply of heating fluid circulated to each heating section 136 from the inlet lines 76 preferably is controlled by a separate one of the valves 78 illustrated in FIG. 9. Each valve 78 is controlled independently of the other valves by a control signal from an onboard control panel (not shown). This supply system provides control over the specific areas of the hull which are heated to melt the adjacent exterior ice layer. Thus, the heating fluid can be circulated to large areas of the hull at any given time, or only specific smaller areas of the hull can receive heating fluid of higher temperature from the available onboard thermal energy supply, if higher melting rates in specific areas of the hull are necessary.

Platform 10, in a typical case, may have overall dimensions of 143 feet in beam and 215 feet in length. The flat bottom of the hull may be 194 feet by 122 feet, and the vertical distance from the hull bottom to the hull high ice line (top of the thickest ice sheet encountered under the conditions shown in FIG. 1) may be about 6 feet 10 inches. The heating sections may extend 6 feet inwardly along the hull bottom from the hard chine bilge 12*a*.

The problem addressed by the present invention, that of melting ice in a metal-to-ice interface system, is complex. Heat must be transferred to the ice counter to the direction of ice mass flow. This presents a very complicated system of three-dimensional heat and mass flow. By this invention, the temperature and flow rate of heating fluid circulated through the heating sections can be controlled, thereby controlling the internal heat transfer rate. The heat transfer rate at the exterior surfaces of the hull, or other surface facing the moving ice layer, is not so easily controlled. A high external heat transfer rate requires a high rate of ice water flow across the external surface, but such a high flow rate is obtained only by virtue of a high heat transfer rate. The grooves or corrugations in the external surfaces, arranged as described, solve this dilemma and the overall problem by assuring that the required high external flow rate of melted ice is obtained.

An advantage of the grooving or corrugating of the hull external surface, as described, is that the ice at the innermost portions of the grooves is subjected to a high heat transfer area relative to its projected area. The grooves or corrugations also create the desired paths for flow of melted ice liquid needed for high external fluid flow rates. The grooved or corrugated surface, in combination with the applied force between the surface and the ice, maintains forced convection heat transfer between the surface and the ice, allowing reliable high melting rates of oncoming ice in excess of 30 feet per day.

What is claimed is:

1. Heat transfer apparatus for melting a solid layer moving toward an object having an exterior heat conducting surface in the path of movement of the layer, the apparatus comprising a series of spaced apart, elongated grooves formed in the exterior surface and located proximately adjacent the portion of the solid layer a be melted, at least a portion of the grooves extending upwardly along said surface to a location above the top surface of the solid layer; and means for directing heat outwardly from the grooved surface to a portion of the layer located proximately adjacent the grooved surface, the grooves providing areas of heat concentration plus means for draining melted material away from between the solid layer and the grooved surface.

2. Apparatus according to claim 1 in which the grooves are substantially linear.

3. Apparatus according to claim 1 in which the grooves are curvilinear.

4. Apparatus according to claim 1 in which the grooved portion of the exterior surface is formed by corrugations.

5. Apparatus according to claim 1 in which the grooved portion of the exterior surface includes a series of spaced apart, generally horizontally extending heat transfer grooves, and a plurality of fluid drainage grooves intersecting the heat transfer grooves and extending in a direction having a vertical component, at least a portion of the drainage grooves extending from a location adjacent the portion of the solid layer to be melted to a location above the top surface of the layer.

6. Apparatus according to claim 1 including means for applying a continuous force between the grooved portion of the exterior surface and the adjacent portion of the layer.

7. Apparatus according to claim 6 in which the force applying means extends from the object to the layer and includes means for adjusting the directional component of the force between the grooved surface and the adjacent portion of the layer in accordance with the instantaneous direction in which the layer is moving.

8. Apparatus according to claim 6 in which the force applying means comprises means for maintaining the object in a fixed position relative to the layer so that movement of the layer toward the object continuously applies a force between the grooved surface and said adjacent portion of the layer.

9. Apparatus according to claim 1 in which the object has means for circulating a heat transfer fluid into direct contact with the interior surface opposite the grooved portion of said exterior surface.

10. Heat transfer apparatus for melting a layer of ice moving toward an object having an exterior heat conducting metal surface in the path of movement of the ice layer, the apparatus comprising a series of spaced apart, elongated grooves formed in a portion of the exterior surface located proximately adjacent the portion of a ice layer to be melted, at least a portion of said grooves extending upwardly along said surface to a location above the top surface of the ice layer; and means for circulating a heat transfer fluid into direct contact with an interior surface of the object opposite the grooved portion thereof to direct heat outwardly from the grooved surface to a portion of the ice layer located proximately adjacent the grooved surface.

11. Apparatus according to claim 10 including means for continuously applying a force between the grooved surface and the adjacent portion of the ice layer.

12. Apparatus according to claim 11 in which the force applying means extends from the object to the ice and includes means for adjusting the directional component of the force between the grooved surface of the adjacent portion of the ice in accordance with the instantaneous direction in which the ice layer is moving.

13. Apparatus according to claim 11 in which the force applying means comprises means for maintaining the object in a fixed position relative to the ice so that movement of the ice toward the object continuously applies a force between the grooved surface of said adjacent portion of the ice.

14. Apparatus according to claim 10 in which the grooves are substantially linear.

15. Apparatus according to claim 10 in which the grooves are curvilinear.

16. Apparatus according to claim 10 in which the grooved portion of the exterior surface is formed by corrugations.

17. Apparatus according to claim 10 in which the grooved portion of the exterior surface includes a series of spaced apart, generally horizontally extending heat transfer grooves, and a plurality of fluid drainage grooves intersecting the heat transfer grooves and extending in a direction having a vertical component, at least a portion of the drainage grooves extending from a location adjacent the portion of the ice to be melted to a location above the top surface of the ice.

18. A floating vessel for use in a body of water covered by a layer of ice subject to lateral motion, the vessel having an exterior thermally conductive metal surface located in the path of movement of the ice layer, and a series of spaced apart, elongated grooves formed in said exterior surface and located proximately adjacent the portion of the ice to be melted, at least a portion of the grooves extending upwardly along said surface to a location selected to exceed the maximum distance between the load waterline and the top of an ice sheet likely to be encountered during use of the vessel in ice; means for directing heat outwardly from the grooved surface of the vessel to the portion of the ice layer which, in use of the vessel in ice, is moving toward the grooved surface of the vessel; and means for continuously applying a force between the grooved surface and the adjacent portion of the moving ice layer, the grooves providing areas of heat concentration plus means for chanelling the melted ice away from between the ice layer and the grooved surface to the body of water.

19. A vessel according to claim 18 in which the grooves are substantially linear.

20. A vessel according to claim 18 in which the vessel hull includes an interior surface opposite the grooved portion of the exterior surface; and including means cooperating with said interior surface of the hull for providing paths of circulation of a heat transfer fluid directly across said interior surface.

21. A vessel according to claim 20 including means for selecting particular ones of said paths for the flow of the heat transfer fluid therealong.

22. A vessel according to claim 20 in which the paths are directed over the interior surface substantially from the bottom of the grooved portion to a location in the vicinity of said selected distance above the load waterline.

23. A vessel according to claim 22 in which a portion of the paths are also distributed to overlie a portion of the bottom of the vessel.

24. A vessel according to claim 18 in which the vessel has a hull of rectangular barge-like plan form configuration having a flat bottom, a hard-chine bilge at the sides and ends thereof from which the hull slopes upwardly and outwardly to a second hard chine above the bottom at the sides and ends thereof, the hull exterior surfaces being substantially linear along each end and side between the bilge and the second chine, at least a portion of said grooves extending from the bilge chine at each of the end and side surfaces to said selected distance above the load waterline.

25. A vessel according to claim 24 in which the second chine is located above the hull load waterline and the grooves extend to the vicinity of the second chine.

26. A vessel according to claim 25 in which the hull end and side surfaces are substantially vertical above the second chine, and the grooves have their upper ends located above the second chine.

27. A vessel according to claim 18 in which the grooves are formed by corrugations.

28. A vessel according to claim 18 in which a first portion of the grooves extends in a generally horizontal direction around the exterior surface of the vessel, and a second portion of the grooves intersects the horizontal grooves and extends upwardly to said selected location above the load waterline.

29. A vessel according to claim 18 including means for moving the exterior surface of the hull transversely back and forth relative to the elongate extent of the grooves extending to said selected location above the load waterline.

* * * * *